US008064184B2

(12) United States Patent
Auf der Maur

(10) Patent No.: US 8,064,184 B2
(45) Date of Patent: Nov. 22, 2011

(54) METHOD AND APPARATUS FOR DISCHARGING ELECTROSTATIC CHARGE IN MULTI-LEAF PRINTED PRODUCTS

(75) Inventor: Konrad Auf der Maur, Gossau ZH (CH)

(73) Assignee: Ferag AG, Hinwil (CH)

( * ) Notice: Subject to any disclaimer, the term of this patent is extended or adjusted under 35 U.S.C. 154(b) by 121 days.

(21) Appl. No.: 12/358,777

(22) Filed: Jan. 23, 2009

(65) Prior Publication Data

US 2009/0195631 A1 Aug. 6, 2009

(30) Foreign Application Priority Data

Jan. 31, 2008 (CH) ..... 0139/08

(51) Int. Cl.
*H05F 3/00* (2006.01)

(52) U.S. Cl. ..... 361/212; 361/214

(58) Field of Classification Search ..... 361/212, 361/214, 221

See application file for complete search history.

(56) References Cited

U.S. PATENT DOCUMENTS

| | | | | |
|---|---|---|---|---|
| 3,617,049 | A * | 11/1971 | Testone | 271/105 |
| 5,228,373 | A * | 7/1993 | Welsch | 83/24 |
| 5,402,304 | A * | 3/1995 | Smith | 361/214 |
| 6,504,700 | B1 | 1/2003 | Hahne et al. | |

FOREIGN PATENT DOCUMENTS

| | | |
|---|---|---|
| DE | 199 47 140 | 3/2001 |
| DE | 20 2005 012 541 | 3/2006 |
| DE | 10 2006 029 066 | 12/2007 |
| EP | 1802178 | 6/2007 |

OTHER PUBLICATIONS

Switzerland Search Report dated Jun. 26, 2008; Switzerland Patent Application No. 1392008.

"Handbuch der Electrostatischen Systeme," Eltex Electrostatic Innovations, Instruction Manual WP-d-ÜP 002-04/04-15.

"Electrostatic Systems, the Sourcebook," Eltex Electrostatic Innovations, Instruction Manual Wp-d-ÜP 002-04/04-15.

* cited by examiner

*Primary Examiner* — Danny Nguyen

(74) *Attorney, Agent, or Firm* — Alston & Bird LLP

(57) ABSTRACT

An ion nozzle (36) generates an air jet (38) comprising charged particles which is incident on the open side edge (52) of the printed products (10). As a result of this, the printed products (10) are bulged and, at the same time, discharge electrostatic charge from the open side edge (52).

10 Claims, 2 Drawing Sheets

METHOD AND APPARATUS FOR DISCHARGING ELECTROSTATIC CHARGE IN MULTI-LEAF PRINTED PRODUCTS

FIELD OF THE INVENTION

The present invention relates to a method and an apparatus for discharging electrostatic charge in two-leaf and/or multi-leaf printed products in accordance with the patent claims 1 and 6.

BACKGROUND

Such printed products, like newspapers, periodicals or parts thereof, have at least two leaves, but in general a substantially larger number of leaves, which lie on one another in the closed state of the printed product. By way of example, two leaves can be formed by a folded sheet, with the two leaves being connected to each other at the fold. However, individual leaves can also be connected to each other at a side edge, forming a back margin. Those edges of the printed product which do not form the back margin or a fold are understood to be the open side edges in the present context.

Discharging electrostatic charge in a material web and a paper web by means of ion nozzles is known, for example, from the "Handbuch der elektrostatischen Systeme" (Handbook of electrostatic systems) by Eltex-Elektrostatik GmbH, Weil am Rhein (imprint: WP-d-ÜP 002-04/04-15). Furthermore, an ion nozzle is also disclosed in the document DE 299 23 560 U1. So the electrostatic charge in a paper web is discharged, the latter is transported past air jets generated by ion nozzles which are directed in the direction of the planar paper web.

BRIEF SUMMARY OF THE INVENTION

It is an object of the present invention to develop a method and an apparatus for efficient discharge of electrostatic charge in printed products having at least two leaves.

This object is achieved by a method in accordance with claim 1 and an apparatus in accordance with claim 6.

An ion nozzle generates an air jet comprising ions which, according to the invention, is incident on an open side edge of a printed product. The printed product is bulged from the open side edge due to this air jet and at the same time is discharged. The adhesion of the leaves of the printed products to each other due to electrostatic charging of the printed products is eliminated, or at least substantially reduced, due to the discharge of electrostatic charge, which in turn improves the bulging and ensures further penetration of the air jet into the respective printed product for further discharge of electrostatic charge. It goes without saying that a plurality of ion nozzles can be used.

Preferably, a flat jet ion nozzle which generates a planar air jet is used. An optimum discharge effect is achieved if the open side edge and, preferably, the printed product are situated in the plane of the planar air jet.

In the process, the air jet is preferably directed at a right angle to the open side edge. This permits homogeneous bulging and discharge of the printed product in the largest possible region of the side edge.

Since electrostatic discharge is a very rapidly occurring process, printed products can be discharged during transport by means of a stationary air jet, and hence a stationary ion nozzle. Particularly preferred developments of the method according to the invention with respect to this are specified in claims 4 and 5.

An apparatus for carrying out the method according to the invention is defined in patent claim 6.

Preferred embodiments of the apparatus according to the invention are specified in the further dependent patent claims.

BRIEF DESCRIPTION OF THE SEVERAL VIEWS OF THE DRAWINGS

The invention is described in more detail on the basis of embodiments illustrated in the drawing, in which, in a purely schematic manner.

DETAILED DESCRIPTION OF THE INVENTION

Figure 1:
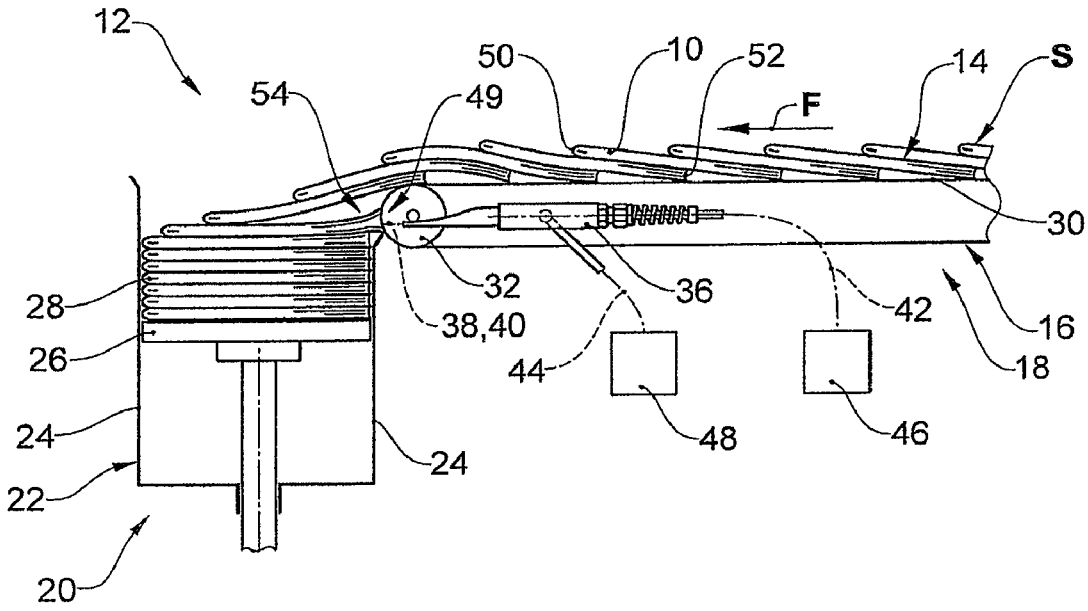
FIG. 1 shows a view of a processing device according to the invention in which printed products are fed to a stacking device by means of a conveyor device and in which electrostatic charge of the printed products is discharged by means of an air jet generated by an ion nozzle.
Figure 2:
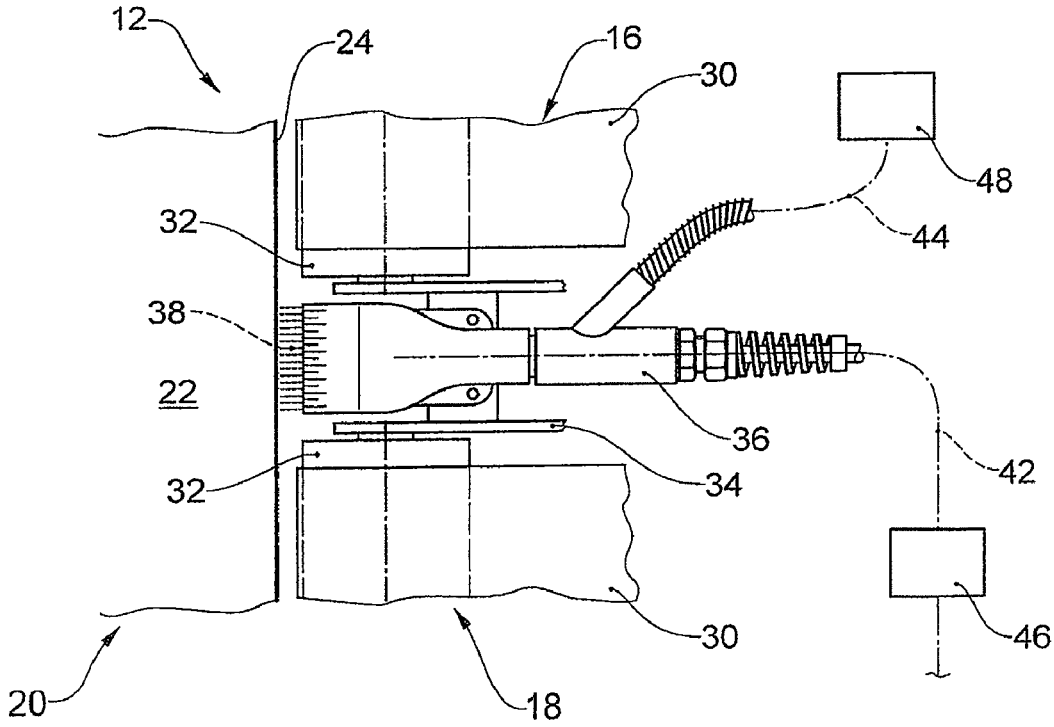
FIG. 2 shows a top view of part of the device shown in FIG. 1 on an enlarged scale.

A first embodiment of an apparatus for discharging electrostatic charge in printed products 10 according to the invention is illustrated in FIGS. 1 and 2. It comprises a processing device 12, which prescribes a movement path 14 for the printed products 10. It has a conveyor device 18 designed as a belt conveyor 16 and a stacking device 20, the stacking shaft 22 of which is arranged at the downstream end of the belt conveyor 16 when seen in the conveyor direction F of the conveyor device 18. The stacking shaft 22, which is delimited on the sides by shaft walls 24, is open toward the top and a shaft floor 26 is arranged therein which can be lifted in a generally known manner by means of a lifting assembly and can be lowered in such a way that, depending on the height of the stack 28 formed, the respectively topmost printed product 10 of the stack 28 is at least approximately at a predefined height.

As can be seen particularly in FIG. 2 (FIG. 2 does not show any printed products 10 for clarity's sake), the belt conveyor 16 has two adjacently arranged conveyor belts 30, which are driven together in the conveyor direction F and which form a bearing surface for the printed products 10. At the downstream end, each of the conveyor belts 30 is guided over a deflector roll 32 assigned thereto, with the two deflector rolls 32 being mounted on a chassis 34 and spaced from one another in the direction of their axis.

Furthermore, an ion nozzle 36 (in the present case a flat jet ion nozzle) is attached to the chassis 34 and arranged between the two conveyor belts 30 and the deflector rolls 32. The ion nozzle is provided for generating a planar air jet 38 which blows parallel to the conveyor direction F and which comprises charged particles (ions), with the planar air jet 38 propagating in a plane 40 which is determined by the ion nozzle 36 and which is oriented parallel to the shaft floor 26 and hence parallel to the stacked printed products 10. The ion nozzle 36 is situated below the bearing surface for the printed products 10 defined by the conveyor belts 30, and the air jet 38 blows into the stacking shaft 22 from over the shaft wall 24 facing the ion nozzle 36.

The ion nozzle 36 is connected in a known manner to firstly a high-voltage lead 42 and secondly to a compressed air lead 44. The high-voltage lead 44 guides high voltage generated in a power supply unit 46 to the electrode or electrodes of the ion nozzle 36. Correspondingly, the compressed air lead 44 is connected to a source of compressed air 48. By way of example, an ion nozzle R35F from the Eltex-Elektrostatik GmbH company, Weil am Rhein, is found to be suitable together with an appropriate power supply unit 46.

The printed products 10 shown in FIG. 1 are a multiplicity of leaves 49, folded printed products which are supplied to the stacking shaft 22 in an overlapping formation S. The movement path 14 of the printed products 10 thus runs on the belt conveyor 16 and, at its end, in the drop direction of the printed products 10 into the stacking shaft 22. In the overlapping formation S, each printed product 10 lies, like scales, on the respectively leading printed product 10, with the fold 50, running at right angles to the conveyor direction F, leading the open side edge 52 lying at the opposite end of the respective printed product 10.

Printed products 10 load the stacking shaft 22 from the top, with the printed products being fed horizontally to the opening 54 of the stacking shaft 22 by means of the belt conveyor 16. The height of the shaft floor 26 is adjusted in a known manner such that the printed products 10 fall down a step, seen in the conveyor direction F, and onto the shaft floor 26 or the stack 28 that has already been formed. As a result of this, the open side edge 52 and its adjacent region of the respectively topmost printed product 10 fed to the stacking shaft 22 is lying free from the subsequent printed product 10 and hence it is not loaded.

The printed products 10 are bulged due to the air jet 38 directed at their open side edge 52 and at the same time their electrostatic charge is discharged. In the shown embodiment, this is optimally achieved by, on the one hand, the topmost printed product 10 fed to the stacking shaft 22 being upwardly exposed at its open side edge 52 until the subsequent printed product 10 is fed to the stacking shaft and, on the other hand, the shaft floor 26 being controlled with regard to its height such that the respectively topmost printed product 10 lies in the plane 40 of the air jet 38.

Figure 3:
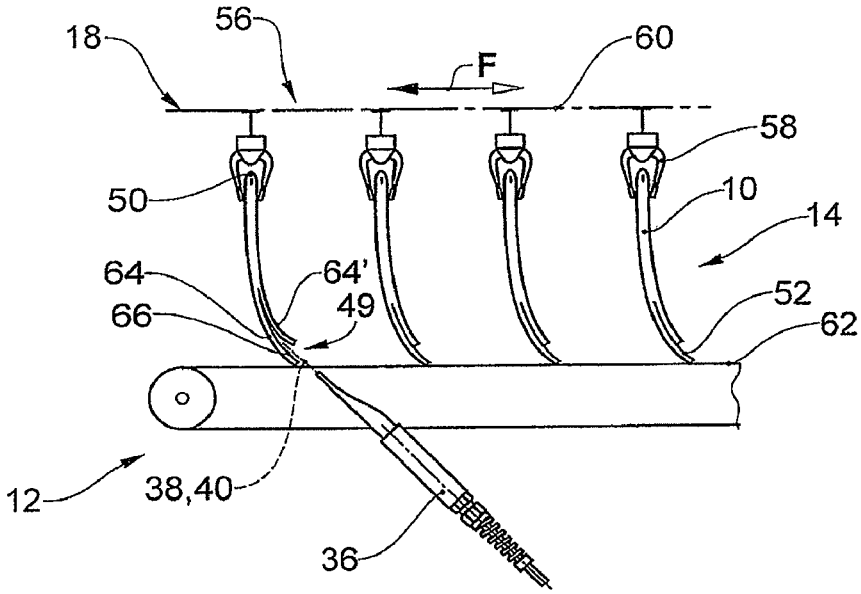
FIG. 3 shows a view of a further processing device for printed products in which the latter are conveyed by means of a clamping conveyor and in which electrostatic charge of the printed products is discharged in the process by means of an air jet generated by an ion nozzle.

A further embodiment of an apparatus for discharging electrostatic charge in printed products 10 according to the invention is illustrated schematically in FIG. 3. Again, the processing device 12 has a conveyor device 18, but the latter is designed as a clamping conveyor 56. Clamps 58 are moved in a known manner in the conveyor direction F by means of a driving element 60, e.g. a circulating pulling element. Every clamp 58 holds one printed product 10 at its fold 50, with the printed products 10 being transported in a hung-up position. The movement path 14 of the printed products is thus determined by the clamping conveyor 56.

Two supporting lists 62, arranged below the clamping conveyor 56 in a similar fashion to the conveyor belts 30 of the embodiment shown in FIGS. 1 and 2, are spaced from one another and are driven in a circulatory manner such that the actively supporting upper strand also moves in the conveyor direction F at least approximately the same speed as the clamps 58. The vertical distance between the clamping conveyor 56 and the supporting lists 62 is less than the corresponding dimension of the printed products 10 so that they are supported by the supporting lists 62 on their open side edge 52 lying opposite the fold 50 and, as a result of this, the printed products 10 are bent against the conveyor direction F in the effective range of the supporting lists 62.

The ion nozzle 36 (in this case it is also preferably a flat jet ion nozzle) is arranged between the two supporting lists 62 such that the air jet 38 is incident at a right angle on the side edges 52 moving past it and the plane 40 defined by the air jet 38 at least approximately coincides with a plane defined by that end region of the printed products 10 which is in the effective range of the air jet 38 with regard to the printed products 10.

Whereas FIG. 1 shows printed products 10 which are folded in the center, the example in accordance with FIG. 3 provides for the clamps 58 to hold printed products 10 which are folded eccentrically. Hence the leaves 49 of one product part 64 (in the present case, the leading product part) protrude over the leaves 49 of the other product part 64' (in the present case, the trailing product part) by a strip-like edge region 66. Since this edge region 66 at least approximately lies in the plane 40 when passing through the air jet 38, the printed product 10 is bulged particularly between the two product parts 64 and 64', with the discharge of electrostatic charge also being particularly prominent in that region, and this permits a reliable subsequent opening of the center of the printed products 10.

It should be mentioned at this point that the processing device 12 in accordance with FIG. 3 can also process printed products 10 which are folded in the center, and that the processing device 12 in accordance with FIGS. 1 and 2 can also process printed products 10 which are folded eccentrically. Furthermore, it is feasible that, in the case of the embodiment in accordance with FIG. 3, the clamps 58 are driven in the direction of the arrow F only shown in outline, that is to say they are driven from left to right. In this case, the supporting lists 62 are preferably driven at a higher speed than the clamps 58 so that the printed products 10 are bent toward the front in the conveyor direction F. In this case, the printed products 10 moving past the ion nozzle 36 are also bulged from the open side edge 52 in a manner identical to the case described above, and the electrostatic charge is also discharged.

Figure 4:
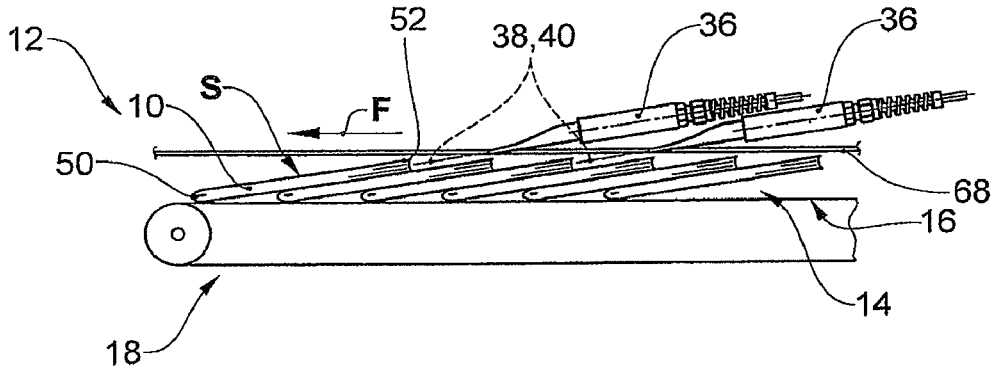
FIG. 4 shows a further processing device in which printed products are conveyed in an overlapping formation by means of a belt conveyor and in which electrostatic charge of the printed products is discharged by means of air jets generated by ion nozzles.

FIG. 4 shows a further embodiment of a processing device 12 for discharging electrostatic charge in printed products 10 according to the invention. The conveyor device 18 is designed as a band conveyor 16 which determines the movement path 14 and by means of which the printed products 10 are transported in an overlapping formation S in the conveyor direction F. In this overlapping formation S each printed product 10 is lying on the respectively trailing printed product 10, with the fold 50 in each case leading the opposite open side edge 52.

Two ion nozzles 36, preferably flat jet ion nozzles, are arranged, one behind the other, in the conveyor direction F above the belt conveyor 16 and are directed such that the planes 40 of the air jets 38 run at least approximately parallel to the printed products 10. The air jets 38 are directed obliquely downward and in the conveyor direction F so that they are incident on the side edges 52 at a right angle.

Furthermore, there are limiting rods 68 on both sides of the ion nozzles 36, which are approximately level with their air jet openings, above the belt conveyor 16 and run in the conveyor direction F. These limiting rods prevent too vigorous bulging of the printed products 10 when, in the process, the latter move past the ion nozzles 36 and bulge and the electrostatic charge is discharged.

Figure 5:
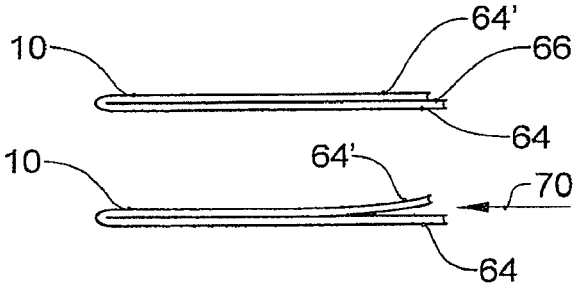
FIG. 5 shows a printed product, in one case with leaves lying on one another and in the other case with bulging and hence separated leaves.

It goes without saying that it is also feasible to drive the belt conveyor 16 against the shown conveyor direction F. In this case, the upper and with respect to the fold 50 open side edge 52 leads. In FIG. 4, printed products 10 which are folded in the center are once again shown. However, printed products 10 which are folded eccentrically can also be processed, with the longer product part 64, protruding over the product part 64' by its edge region 66, preferably being arranged to lie underneath, as shown in FIG. 5. This results in particularly vigorous bulging of the printed products 10 while simultaneously discharging electrostatic charge between the two product parts 64 and 64'. By means of an opening element 70, which is only illustrated schematically by an arrow, subsequent central opening is reliably possible.

In the illustrated examples, the printed products 10 are blown onto from their side edge lying opposite the fold 50. However, it is also possible that one or both open side edges adjacent to the fold 50 are blown on by an ion nozzle 36 for discharging electrostatic charge in the printed product 10.

That which is claimed:

1. A method for discharging electrostatic charge in two-leaf and/or multi-leaf printed products, the leaves being connected to each other at a side edge in which an air jet is directed at an open side edge of the printed products lying at the opposite end of the side edge where the leaves are connected to each other by means of an ion nozzle and the printed products are bulged and is discharged from the side edge by means of the air jet.

2. The method as claimed in claim 1, wherein a planar air jet is guided toward the side edge by means of a flat jet ion nozzle, wherein the side edge is at least approximately in the plane of the air jet.

3. The method as claimed in claim 1, wherein the air jet is directed at the side edge at least approximately a right angle thereto.

4. The method as claimed in claim 1, wherein the printed products are fed, one after another, to a stacking shaft by means of a conveyor device and the air jet is directed at the open side edge at the opening of the stacking shaft or adjacent thereto.

5. The method as claimed in claim 1, wherein the open side edge of the printed products is transported through the stationary air jet by means of a conveyor device.

6. An apparatus for discharging electrostatic charge in two-leaf and/or multi-leaf printed products, having a connected side edge and an open side edge lying at the opposite end of the side edge where the leaves are connected to each other, comprising a processing device for the printed products which prescribes a movement path of the printed products and, arranged by the movement path, an ion nozzle, the air jet thereof being directed at the open side edge of the printed products in order to bulge and discharge the printed products passing by the ion nozzle from the open side edge.

7. The apparatus as claimed in claim 6, wherein the ion nozzle is a flat jet ion nozzle.

8. The apparatus as claimed in claim 6, wherein the processing device comprises a conveyor device for the printed products and a stacking shaft to which the printed products can be fed, one after the other, by means of the conveyor device, wherein the ion nozzle is arranged at the opening of the stacking shaft or adjacent thereto.

9. The apparatus as claimed in claim 6, wherein the processing device comprises a conveyor device for the printed products which moves the printed products past the stationary ion nozzle.

10. The method as claimed in claim 1, wherein the two-leaf and/or multi-leaf printed products having a fold and wherein an open side edge of the printed product is lying at the opposite end of the fold.

* * * * *